United States Patent [19]

Conrad

[11] Patent Number: 4,479,599

[45] Date of Patent: Oct. 30, 1984

[54] POSITIONING AND FIRING DEVICE FOR EXPLOSIVE-ACTUATED TOOLS

[76] Inventor: James R. Conrad, 1631 Grandview, Glendale, Calif. 91201

[21] Appl. No.: 431,195

[22] Filed: Sep. 30, 1982

[51] Int. Cl.[3] ..... B25C 1/10; B25C 1/18

[52] U.S. Cl. ..... 227/9; 227/156

[58] Field of Search ..... 227/9, 10, 11, 156

[56] References Cited

U.S. PATENT DOCUMENTS 3,682,364 8/1972 Maier ..... 227/9

3,797,721 3/1974 Clumb ..... 227/9

4,153,193 5/1979 Urbanowicz ..... 227/156

4,284,223 8/1981 Salcido et al. ..... 227/156 X

*Primary Examiner*—Paul A. Bell

*Attorney, Agent, or Firm*—Wagner & Bachand

[57] ABSTRACT

Ceiling hanger clip 20 installation is facilitated by carrying a standard clip fastener firing gun 16 on an extended handle 12 having means 86, 98, for tripping the gun trigger 28 responsive to thrusting thereof against the ceiling.

13 Claims, 5 Drawing Figures

POSITIONING AND FIRING DEVICE FOR EXPLOSIVE-ACTUATED TOOLS

TECHNICAL FIELD

This invention has to do with a positioning and firing devices for explosive-actuated tools, such as Ramset® and Hilti® guns for the driving of fasteners into building walls, floors and ceilings. More particularly, the invention relates to ceiling hanger installation applications of such tools, especially for firing nail-like fastener pins carrying suspended ceiling hanger clips into concrete overheads. In such applications, the clip which is typically a right angled metal member, is mounted on the gun muzzle secured by the fastener pin which is partly received by the muzzle bore. The gun is placed against the ceiling for firing. The gun trigger is operated, the explosive charge previously placed in the gun is fired, and the resultant gases drive the fastener into the ceiling, usually acting through an intermediate traveler in the muzzle bore.

Because the ceilings are necessarily a good distance from the floor, the operator usually uses a ladder or scaffold to position himself for presentation of the gun muzzle and its clip-fastener assembly to the ceiling.

BACKGROUND ART

It is known to have extension devices which enable placement of the gun against the ceiling by an operator standing on the floor. Because the gun trigger, intended for firing with the index finger, is thus greatly distanced from the operator, expedients such a ropes to effect firing have been employed. This operation is cumbersome. It is further known, as described in U.S. Pat. No. 3,797,721, that a firing charge can be detonated by having the fastener itself act as the firing pin. The charge is rim-fired by the fastener being displaced into the firing chamber by pressing the fastener against the ceiling, with or without an extension device, and then hitting the device with force sufficient to fire it.

This patented system requires special charges and fasteners which are much less widely available than the standard charges and ceiling clip-fastener assemblies used with the Hilti® and Ramset® guns. Most installers own the standard guns, using them for studs, flooring, and other construction jobs in addition to ceiling installation, and prefer the convenience of standard and widely available components.

DESCRIPTION OF THE INVENTION

There is a need, therefore, for a positioning and firing means which is compatible with one or preferably most to all standard guns, which allows remote actuation of the firing trigger, and which is easily manipulated for rapid placement of the gun at the desired portion of the ceiling, but which in addition is readily separated from the gun when ceiling work is not to be done. It is a major objective of the invention to provide a positioning and firing device comprising a standard powder-actuated tool or gun and a handle therefor permitting remote actuation of the firing trigger, easy manipulation for rapid placement of the gun at the ceiling, self firing in response to thrusting contact of the gun muzzle with the ceiling, and double safety features ensuring firing only when the gun muzzle is forced backward by the ceiling, and locking against firing when the device is in a nonvertical orientation.

These and other objects of the invention to become apparent hereinafter are realized by provision of a positioning and firing device for use with an explosive-actuated, trigger-responsive ceiling hanger clip installation tool operative by trigger displacement to embed in a ceiling a clip-supporting fastener carried forwardly thereby, the handle comprising a pole adapted to be grasped at one end by an operator and having at the opposite end a relatively movable tool-carrying cradle, and means displacing the trigger responsive to a predetermined displacement of the cradle relative to the pole in tool actuating relation.

In particular embodiments, the pole is tubular and adapted to reach a ceiling above an operator; and the tool comprises a gun having a generally convex body, a laterally disposed trigger, and an axially displaceable outwardly spring biased muzzle by which the clip-supported fastener is carried for presentation to a ceiling.

In such and like embodiments, the cradle typically comprises an axially elongated, rigid body having a head portion adapted to receive the tool, and a base portion adapted to be coupled to the pole in relatively movable relation; and the cradle base portion is generally cylindrical and has an axial bore, the trigger displacing means including: a shaft coupled to the pole and journaled in the bore in cradle and pole relative movement-accommodating relation; and a link between the shaft and the trigger responsive to shaft movement to actuate the trigger, the trigger displacing means further preferably comprises spring means biasing the shaft against trigger actuating movement.

Further, in the mentioned embodiments: the biasing force of the shaft-biasing spring is greater than the biasing force against the gun muzzle, whereby the muzzle is fully depressed by engagement with the ceiling before the trigger is displaced by movement of the shaft; the link comprises an arm axially displaceable by the biasing spring-opposed movement of the shaft, and means translating axial displacement of the arm into actuating movement of the trigger; the shaft is axially translatable within the bore, the arm lies transversely of the bore in the path of the shaft and is pivoted on the cradle base for downward movement outside the cradle base in response to shaft movement-induced upward movement within the cradle base bore, and there is also included a trigger-engaging means coupling the arm to the trigger for actuating movement responsive to shaft axial translation within the cradle base bore upon relative movement of the handle pole and cradle.

Preferably, the shaft is transversely slotted to receive the arm, engages the spring biasing means above the arm, and is fixed to the pole opposite the operator grasped end thereof, whereby operator thrusting of the gun muzzle against a ceiling axially displaces the muzzle against its spring bias preferentially, and thereafter displaces the shaft within the base bore against its spring bias, pivoting the arm in trigger engaging means displacing relation, and thereby displacing the trigger in gun actuating relation.

In such and like embodiments, the bore and shaft typically have close-fitting shoulders, and include also positionally sensitive means blocking shaft movement within the bore, the means comprising a discrete element normally engaged between the shoulders and movable out of such engagement in response to upwardly vertical orientation of the handle, whereby gun actuation is blocked when the gun points downward. The discrete element preferably comprises a rigid ball, and the cradle base defines an angularly directed channel intersecting the axial bore and adapted to receive the rigid ball out of engagement with the shoulders responsive to vertically upright disposition of the handle.

In a highly particularly preferred embodiment, the invention provides a positioning and firing device for use with a ceiling hanger clip installation tool comprising a gun having a generally convex body, a laterally disposed trigger, and a muzzle outwardly biased by a first biasing spring against gun discharge unless the muzzle is axially displaced against the spring and supporting the clip and fastener for presentation to a ceiling to effect muzzle displacement, the gun being operative by trigger displacement to embed in a ceiling the clip supporting fastener carried by the muzzle; the handle comprising an axially elongated tube adapted to be grasped at one end by an operator, and having at the opposite end a cradle having a head with a generally concave recess to receive the gun body and means to secure the gun body therein, and a generally cylindrical base having a central bore and a longitudinal slot within the wall surrounding the bore; an axially movable shaft partially within the bore and coupled to the handle tube, the shaft being locally reduced in diameter along its length and locally transversely slotted opposite the bore wall slot; a second biasing spring seated in the bore and engaged with the shaft above the slot therein, the second biasing spring having greater resistance to axial compression produced by relative movement of the handle tube and the cradle than the first biasing spring has to axial displacement of the muzzle on engagement of the muzzle with a ceiling whereby the muzzle is axially displaced before axial displacement of the shaft; and a linkage between the shaft and gun trigger, the linkage comprising a transversely disposed arm pivoted on a pin secured in the bore wall, the arm having an interior portion in shaft and bore wall slot received relation for upward pivoting displacement by axial translation of the shaft within the bore responsive to relative movement between the handle and the gun and an exterior portion beyond the cradle base, and a hook extending alongside the gun body and coupled to the trigger, the hook being coupled to the arm for exterior portion downward displacement in response to upward displacement of the arm interior portion by the shaft, whereby thrusting of the gun muzzle against a ceiling displaces the muzzle, then displaces the shaft within the bore, tipping the arm and displacing the trigger hook and trigger thereby.

In this embodiment the shaft reduced portion preferably is delimited by an annular shoulder, and there is further included a metal ball adapted to engage the shoulder in shaft movement blocking relation when the gun points down, the bore wall having a downwardly and outwardly directed channel in registry with the shoulder to receive the ball in shaft shoulder unblocking relation.

THE DRAWING

The invention will be further described as to an illustrative embodiment in connection with the accompanying drawings in which.

PREFERRED MODES

Figure 1:
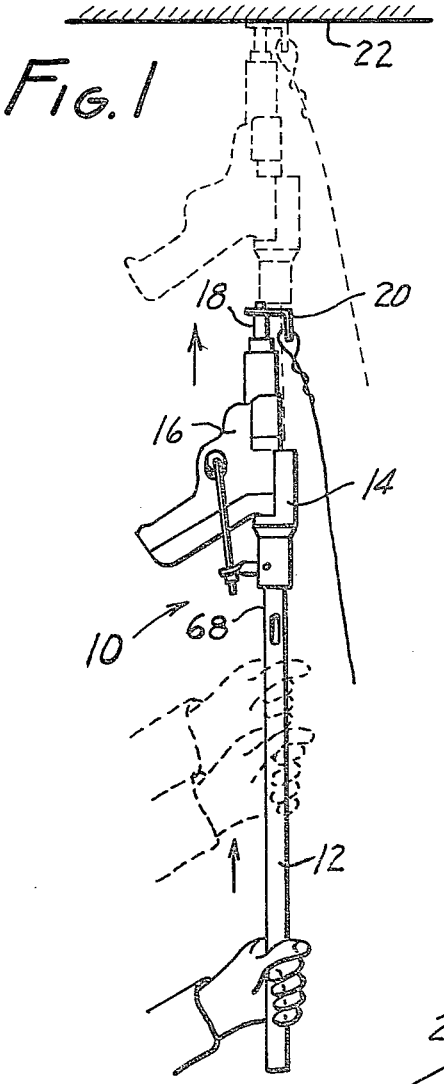
FIG. 1 is a perspective view of the invention positioning and firing device in use in a ceiling installation of a hanger and clip assembly.

With reference now to the drawings in detail, the positioning and firing device 10 comprises an elongated tubular handle 12, adapted to be grasped at its lower end by an operator as shown, and carrying a cradle 14 to be hereinafter more particularly described. An explosive-actuated tool 16 such as a Hilti® or Ramset® gun is cradled in cradle 14 in upright orientation, the tool including a muzzle 18 and having a clip and hanger assembly 20 carried on top of it for presentation to the ceiling 22.

As indicated in FIG. 1, the device 10 is thrust toward the ceiling 22. The impact results in self-firing of the tool 16 by virtue of movement between the handle 12 and the axially longitudinally extended cradle 14, and trigger operating structure 24 carried by the cradle as will now be described.

Figure 2:
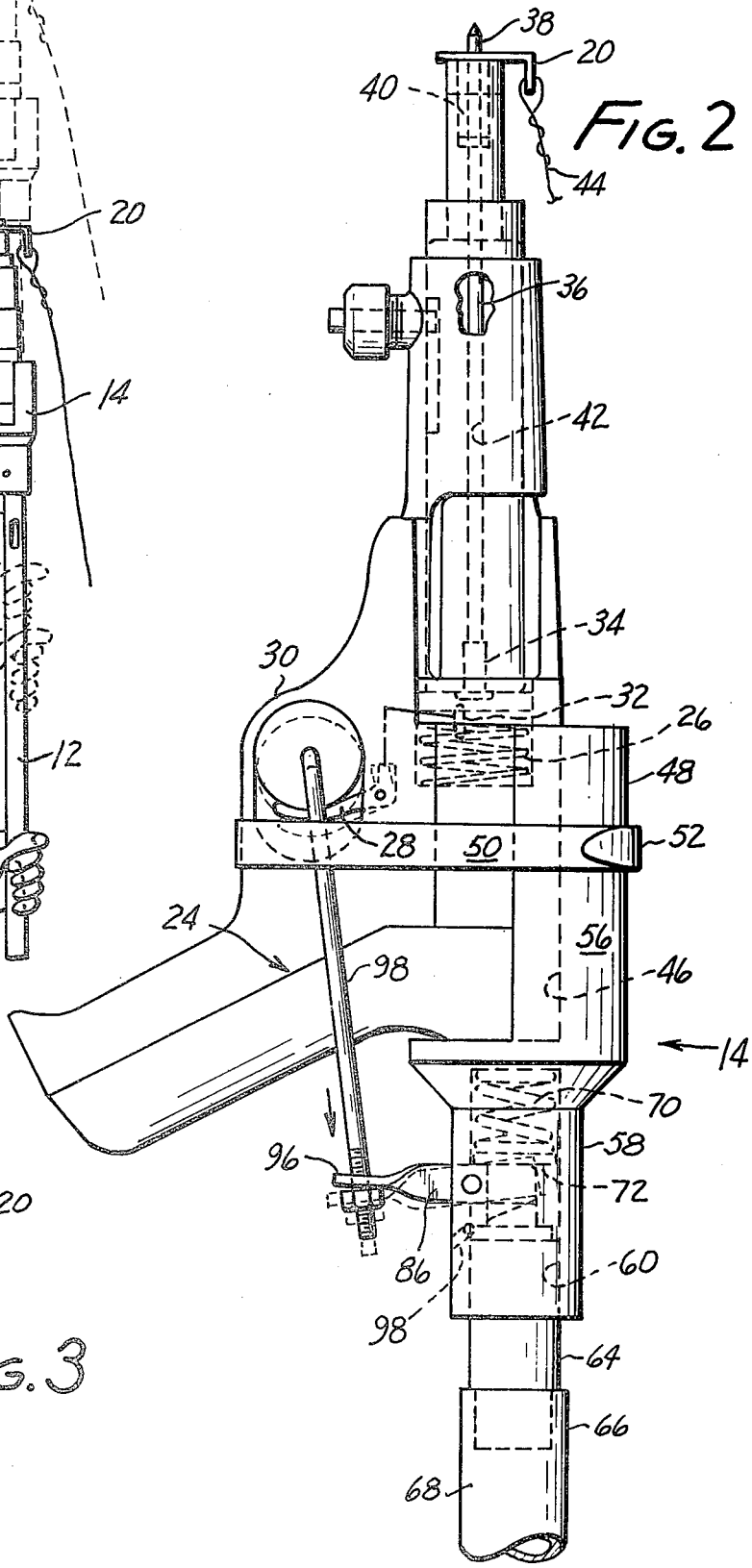
FIG. 2 is an elevation view of the device assembled with a tool.
Figure 3:
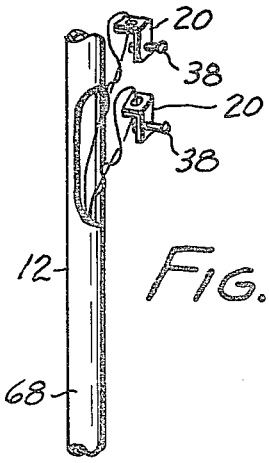
FIG. 3 is a fragmentary view of a section of the device handle pole showing a clip assembly storage feature.
Figure 4:
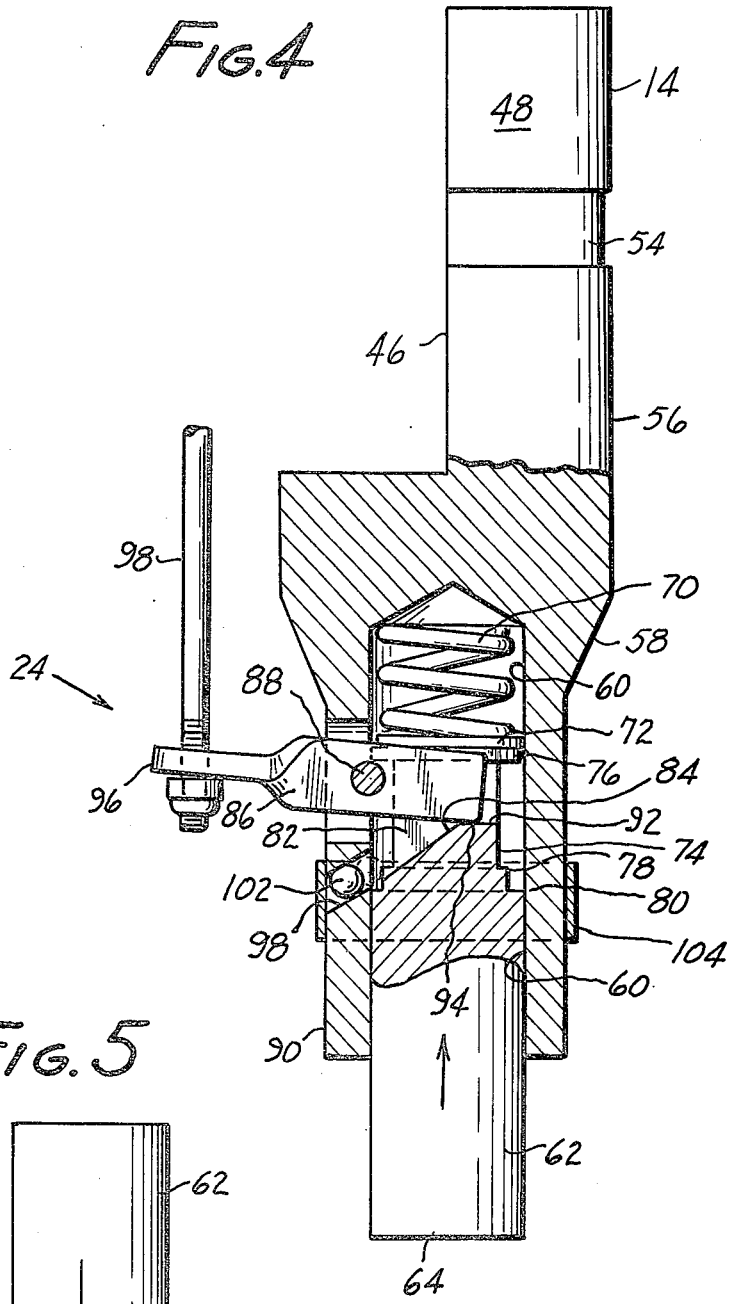
FIG. 4 is a view in vertical section of the device.

Turning to FIGS. 2 and 4, the tool 16 is generally conventional, being convex in body and terminating upwardly in the muzzle 18. In accordance with standard industry practice, the tool muzzle 16 is spring biased outwardly and must be depressed against the force of spring 26 before the tool can be fired. The tool 16 has a laterally projecting trigger 28, protected by guard 30 conventionally connected by means shown schematically to firing pin 32. Upon displacement of the trigger 28 the firing pin moves forwardly striking the rim of explosive charge 34. Gases generated by the charge 34 firing propel pin 36 a portion of which only is shown, into contact with the fastener 38 which has been placed in cylindrical recess 40 in the muzzle 18. As shown the fastener 38 is preassembled with clip 20 carrying hanger wire 44, conveniently taken from a supply thereof in handle 12, see FIG. 3, before being placed in the recess 40. Thus, propulsion of the pin 36 within the bore 42 ejects the fastener 38 into the ceiling 22.

Turning to the invention positioning and firing device 10 which is useful with most if not all tools typified by tool 16 in the drawing, the tool is received in a concave recess 46 defined by the head 48 of the cradle 14. A strap 50 having buckle 52, suitably a hose clamp fastener, seated in groove 54 in the cradle back 56 extends around the tool 16 just below the trigger guard 30 and secures the tool in the cradle 14.

The cradle 14 further includes a base 58 which is generally cylindrical and has an axial bore 60. A shaft 62 is journaled in cradle base bore 60 for axial translation, the lower portion 64 being rigidly coupled to the upper end 66 of pole 68 defining the handle 12. A spring 70 of greater spring force or resistance to compression than previously mentioned spring 26 is positioned at the top of bore 60. As can best be seen in FIG. 4, the shaft 62 has a reduced diameter portion 74, a spring stop 76 abutting plate 72 thereabove, and stepped shoulders 78, 80 therebelow, with reference to the device 10 orientation in FIGS. 2 and 4. The shaft reduced portion 74 is transversely cut to define a diametrical slot 82. The slot 82 has a sloping bottom wall 84 for purposes to appear.

A lever arm 86 moves freely within slot 82 pivoted on pin 88 which is supported by the wall 90 of the cradle base bore 60. Arm 86 is biased downwardly by spring 70 acting on plate 72 and is deflectable about its pivoted mounting on pin 88 by upward movement of shaft 62, shaft slot shoulder 92 bearing against the arm inner portion 94. As will be evident, the outer portion 96 of the arm 86 correspondingly is displaced downwardly to the limit set by the slot sloped bottom wall 84. A linkage extends between arm portion 96 and trigger 28 comprising a trigger hook 98 bolted loosely to the arm 86 at one end and hooked to the trigger at the opposite end through the center of block 100 which engages the trigger within the trigger guard 30.

Thusfar described, the operation of the device 10 is that the clip 20 and fastener 38 assembly is thrust against the ceiling, the muzzle is axially displaced against the force of spring 26, which as noted has a lower resistance than spring 70, so that spring 70 is not compressed. As explained above, the retraction of the muzzle 18 as a precondition to the tool firing is a standard safety feature of the tools being discussed. It is particularly noteworthy that this feature is retained in the present invention despite the addition of a spring-biased self-firing feature, the combination being made possible by having a preferential compression of the safety spring 26 before the compression of the shaft biasing spring 70.

The shaft 62 being fixed to the pole 68 continues its movement after the cradle 14 stops following bottoming of the spring 26, such further shaft movement being resisted by the spring 70. This movement of the pole 68, and shaft 62, operates lever arm 86, causing it to pivot, downwardly displacing the hook 98, and the trigger 28, firing the tool 16 by the sequence described above.

It will be noted that the mere thrusting of the device against the ceiling is sufficient to fire it, eliminating cumbersome tugging of lanyard-like cords and permitting firing remote from the operator, and placement of clips without use of ladders or scaffolds.

Figure 5:
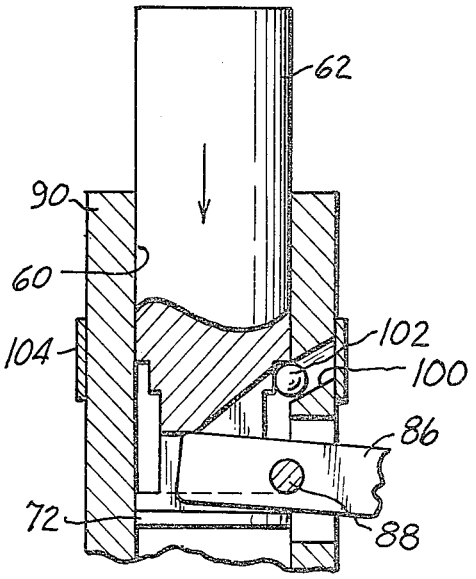
FIG. 5 is a fragmentary view generally like FIG. 4, but inverted showing the safety lock feature of the device.

As a further safety feature, and with particular reference to FIGS. 4 and 5, the device cradle 14 has a positive lock against inadvertent discharge of the tool. This is provided by a ball and channel arrangement wherein a channel 100 extends at a slant from the bore 60 in registry with the upper shoulder 78 of the shaft reduced portion 74. A rigid ball 102, of metal or an engineering plastic, rolls freely in the channel 100 and is sized to lodge between the shoulder 78 and the bore wall 90 when at the inner end 91 of the channel. See FIG. 5. Thus the ball 102 blocks the movement of shaft 62 when the device 10 is pointed other than vertically upwardly. This prevents discharge when the tool, or gun as it is sometimes referred to herein, is pointed downwardly, but permits discharge when the gun is pointed upward, or extends horizontal, as is the case when firing fasteners into vertical walls. It has been found that danger of injury from accidental discharge is greatest when the gun is discharged downward, e.g. when dropped gun first onto a foot. The conventional safety feature at the muzzle cooperates with the device safety feature by requiring the tool be actually engaged with a surface before discharge is permitted, and in the unlikely event that contact with a worker's foot would sufficiently displace the muzzle, the positive block provided by the ball 102 as described, will prevent discharge of the gun. The channel 100 is conveniently bored at a suitable angle in the wall 90, and the outer opening covered with sleeve 104. The channel is suitably placed as shown on the same side of the bore as the trigger, but for added safety, the channel 100 can be on the opposite side of the apparatus, so that when the apparatus is horizontal, and the trigger down as is usually the case, actuation of the gun is blocked.

The objectives of the invention are thus met, including provision of a safe, remotely operative, self-firing device for the presentation of fastener and clip assemblies to a ceiling with ease of manipulation, versatility in choice of tools to be used, convenience in use of standard components, and simplicity, requiring merely a thrust of the loaded tool at the end of the handle against the ceiling; everything else is taken care of automatically.

I claim:

1. A positioning and firing device for use with an explosive-actuated, trigger-responsive ceiling hanger clip installation tool operative by trigger displacement to embed in a ceiling a clip-supporting fastener carried forwardly thereby, said tool comprising a gun having a generally convex body, a laterally disposed trigger, and an axially displaceable outwardly spring-biased muzzle by which said clip-supported fastener is carried for presentation to a ceiling, said handle comprising a pole adapted to be grasped at one end by an operator and having at the opposite end a relatively movable tool-carrying cradle, said pole being axially translatable within said cradle for actuating movement of said trigger, and link means beyond said tool for displacing said trigger responsive to a predetermined axial translation displacement of said cradle relative to said pole in tool actuating relation.

2. Positioning and firing device according to claim 1, in which said pole is tubular and adapted to reach a ceiling above an operator.

3. Positioning and firing device according to claim 1, in which said cradle comprises an axially elongated, rigid body having a head portion adapted to receive said tool, and a base portion adapted to be coupled to said pole in relatively movable relation.

4. Positioning and firing device according to claim 3, in which said cradle base portion is generally cylindrical and has an axial bore, said trigger displacing means including: a shaft coupled to said pole and journaled in said bore in cradle and pole relative axial translating movement-accommodating relation; and said link is between said shaft and said trigger responsive to shaft movement to actuate said trigger.

5. Positioning and firing device according to claim 4, in which said trigger displacing means further comprises spring means biasing said shaft against trigger actuating movement.

6. Positioning and firing device according to claim 5, in which the biasing force of said shaft-biasing spring is greater than the biasing force against said gun muzzle, whereby said muzzle is fully depressed by engagement with the ceiling before said trigger is displaced by movement of said shaft.

7. Positioning and firing device according to claim 6, in which said link comprises an arm axially displaceable by the biasing spring-opposed movement of said shaft, and means translating axial displacement of said arm into actuating movement of said trigger.

8. Positioning and firing device for use with an explosive-actuated, trigger responsive ceiling hangar clip installation tool operative by trigger displacement to embed in a ceiling a clip-supporting fastener carried forwardly thereby, said tool comprising a gun having a generally convex body, a laterally disposed trigger, and an axially displaceable outwardly spring biased muzzle by which said clip-supported fastener is carried for presentation to a ceiling, said handle comprising a pole adapted to be grasped at one end by an operator and having at the opposite end a relatively movable tool carrying cradle, said cradle comprising an axially elongated, rigid body having a head portion adapted to receive said tool, and a base portion adapted to be coupled to said pole in relatively movable relation, said cradle base portion being generally cylindrical and having an axial bore, said trigger displacing means including: a shaft coupled to said pole and journaled in said bore in cradle and pole relative movement-accommodating relation and spring means biasing said shaft against trigger actating movement with a biasing force greater than the biasing force of said gun muzzle, whereby said muzzle is fully depressed by engagement with the ceiling before said trigger is displaced by movement of said shaft; and a link between said shaft and trigger and said trigger being responsive to shaft movement to actuate said trigger, said link comprising an arm axially displaceable by the biasing spring-opposed movement of said shaft, and means translating axial displacement of said arm into actuating movement of said trigger responsive to a predetermined displacement of said cradle relative to said pole in tool actuating relation said shaft being axially translatable within said bore, said arm lying transversely of said bore in the path of said shaft and pivoted on said cradle base for downward movement outside said cradle base in response to shaft movement-induced upward movement within said cradle base bore, and trigger-engaging means coupling said arm to said trigger for actuating movement responsive to shaft axial translation within said cradle base bore upon relative movement of said handle pole and cradle.

9. Positioning and firing device according to claim 8, in which said shaft is transversely slotted to receive said arm, engages said spring biasing means above said arm, and is fixed to said pole opposite the operator grasped end thereof, whereby operator thrusting of said gun muzzle against a ceiling axially displaces said muzzle against its spring bias preferentially, and thereafter displaces said shaft within said base bore against its spring bias, pivoting said arm in trigger engaging means displacing relation, and thereby displacing said trigger in gun actuating relation.

10. Positioning and firing device according to claim 9, in which said bore and shaft have close-fitting shoulders, and including also positionally sensitive means blocking shaft movement within said bore, said means comprising a discrete element normally engaged between said shoulders and movable out of such engagement in response to upwardly vertical orientation of said handle, and wherein gun actuation is blocked when the gun is pointed downward.

11. Positioning and firing device according to claim 10, in which said discrete element comprises a rigid ball, and said cradle base defines an angularly directed channel intersecting said axial bore and adapted to receive said rigid ball out of engagement with said shoulders responsive to said upwardly vertical disposition of said handle.

12. A positioning and firing means for use with a ceiling hanger clip installation tool comprising a gun having a generally convex body, a laterally disposed trigger, and a muzzle outwardly biased by a first biasing spring against gun discharge unless said muzzle is axially displaced against said spring and supporting said clip and fastener for presentation to a ceiling to effect muzzle displacement, said gun being operative by trigger displacement to embed in a ceiling the clip supporting fastener carried by said muzzle; said handle comprising an axially elongated tube adapted to be grasped at one end by an operator, and having at the opposite end a cradle having a generally concave head to receive said gun body and means to secure said gun body therein, and a generally cylindrical base having a central bore and a longitudinal slot within the wall surrounding said bore; an axially movable shaft partially within said bore and coupled to said handle tube, said shaft being locally reduced in diameter along its length and locally transversely slotted opposite said bore wall slot; a second biasing spring seated in said bore and engaged with said shaft above the slot therein, said second biasing spring having greater resistance to axial compression produced by relative movement of said handle tube and said cradle than said first biasing spring has to axial displacement of said muzzle on engagement of said muzzle with a ceiling whereby said muzzle is axially displaced before axial displacement of said shaft; and a linkage between said shaft and gun trigger, said linkage comprising a transversely disposed arm pivoted on said bore wall, said arm having an interior portion in shaft and bore wall slot received relation for upward pivoting displacement by axial translation of said shaft within said bore responsive to relative movement between said handle and said gun and an exterior portion beyond said cradle base, and a hook extending alongside said gun body and coupled to said trigger, said hook being coupled to said arm for exterior portion downward displacement in response to upward displacement of said arm interior portion by said shaft, whereby thrusting of said gun muzzle against a ceiling displaces the muzzle, then displaces the shaft within said bore, tipping said arm and displacing the trigger hook and trigger thereby.

13. Positioning and firing device according to claim 12, in which said shaft reduced portion is delimited by an annular shoulder, and including also a metal ball adapted to engage said shoulder in shaft movement blocking relation when said gun is pointed downward, said bore wall having a downwardly and outwardly directed channel in registry with said shoulder to receive said ball in shaft shoulder unblocking relation.

* * * * *